US008088253B2

(12) United States Patent
Saetherasen

(10) Patent No.: US 8,088,253 B2
(45) Date of Patent: Jan. 3, 2012

(54) DIGESTER SCREEN FOR A CONTINUOUS CELLULOSE PULP DIGESTER

(75) Inventor: Jonas Saetherasen, Hammaro (SE)

(73) Assignee: Metso Paper Sweden AB, Karlstad (SE)

( * ) Notice: Subject to any disclaimer, the term of this patent is extended or adjusted under 35 U.S.C. 154(b) by 55 days.

(21) Appl. No.: 12/743,574

(22) PCT Filed: Nov. 27, 2008

(86) PCT No.: PCT/SE2008/051369

§ 371 (c)(1),
(2), (4) Date: May 19, 2010

(87) PCT Pub. No.: WO2009/070115

PCT Pub. Date: Jun. 4, 2009

(65) Prior Publication Data

US 2010/0276098 A1 Nov. 4, 2010

(30) Foreign Application Priority Data

Nov. 30, 2007 (SE) ..... 0702643

(51) Int. Cl.
*D21C 7/00* (2006.01)

(52) U.S. Cl. ..... 162/237

(58) Field of Classification Search ..... 162/237, 162/236, 246, 241, 245, 251
See application file for complete search history.

(56) References Cited

U.S. PATENT DOCUMENTS 5,234,550 A * 8/1993 Ekholm et al. ..... 162/251
6,039,841 A * 3/2000 Hernesniemi ..... 162/251
6,344,112 B1 * 2/2002 Hernesniemi ..... 162/251

* cited by examiner

*Primary Examiner* — Mark Halpern
(74) *Attorney, Agent, or Firm* — Rolf Fasth; Fasth Law Offices

(57) ABSTRACT

The digester screen is for a continuous digester in which cooked cellulose pulp is produced. The digester screen has a number of screen bars arranged vertically in the continuous digester that have withdrawal slots (S) between the fixed screen bars through which withdrawal slots cooking fluid can be withdrawn from the column of pulp (P) of the digester. By having every second screen bar fixedly arranged and recessed a distance (D) relative to the neighboring screen bar an increased withdrawal capacity for the screen is obtained.

18 Claims, 3 Drawing Sheets

DIGESTER SCREEN FOR A CONTINUOUS CELLULOSE PULP DIGESTER

PRIOR APPLICATION

This application is a U.S. national phase application based on International Application No. PCT/SE2008/051369, filed 27 Nov. 2008.

TECHNICAL AREA

The present invention concerns a digester screen in a continuous digester for the production of cellulose pulp.

BACKGROUND AND SUMMARY OF THE INVENTION

Several different digester screens have been developed during the past 50 years, and used to be able to withdraw cooking fluids from continuous digesters. The requirement for well-functioning digester screens is increasing in pace with

- the loading of existing digesters far above their original production capacity, where increased withdrawal volumes of cooking fluid are required in the digester flows, and
- larger digesters, the production capacities of which lie over 4,000 tonnes of pulp per day, and in which the digesters have a diameter greater than 8 meters.

Conventionally, screen designs have been used as those that are shown in "Chemical Pulping Book 6A" (ISBN 952-5216-06-3), page A537 These are manufactured either as slotted ("mill-slotted") screen plates or as screens having bars ("profile bars"), and the examples in "Chemical Pulping" are taken from Ahlstrom Machinery (Kamyr Inc.). These screen structures are located in the digester wall in the form of square screen surfaces, either as a continuous line of screens, around the complete circumference of the digester wall, composed of several square screen surfaces; or as several lines of screens arranged above each other, in the case in which it is desired to withdraw large volumes of cooking fluid. It has proved to be the case in practice that these screen surfaces do not need to have closely arranged withdrawal slots, since one withdrawal slot has the capacity to allow the withdrawal of cooking fluid also in the horizontal direction. It is here to be envisaged that the screens are to withdraw cooking fluid also from the centre of the column of pulp, and this may correspond to a distance of 4-5 meters in a digester that has a diameter of 8-10 meters. It is therefore often sufficient to place screen surfaces in the wall of the digester in what is known as a "square" pattern, with one blank between each screen surface, having a corresponding area. When two lines of screens are located one above the other, a screen surface having a chessboard pattern is then formed in the screen section of the digester.

It is critical for the design of the screens that they do not become clogged, and screens with vertical withdrawal slits are therefore preferred, and this allows the sinking column of pulp to "slide" down over the screen surface in the direction over the withdrawal slots, providing an abrasive action and thus keep these slots free.

Kamyr A B applied for a patent in 1990 for an improved withdrawal screen, U.S. Pat. No. 5,234,550. Two different screen bar designs were revealed in this screen. One design (FIG. 1) had pointed screen bars facing in towards the column of chips and with recessed withdrawal slots between these pointed bars, and another design (FIG. 2) had a screen surface that was similar to a trapezium-corrugated surface and withdrawal slots at the bottom of the trapezium-corrugated surface. The purpose of these designs was to prevent the column of chips from rotating over the screen surface and to create a recessed withdrawal slot.

One concept for improving the capacity of the screens is revealed in SE 501243 (equal to WO 9516817) filed by Kamyr A B, in which the screen bars and thus the withdrawal slots are arranged horizontally. The greatest problem with this design is that it is difficult and expensive to manufacture, since each screen bar must be bent to have a curvature that is adapted to the diameter of the digester.

In attempts to achieve an improved screen function, several patents corresponding to U.S. Pat. Nos. 6,039,841 and 6,344,112 of Kamyr Inc. have been filed, in which the withdrawal slots of the screens are arranged obliquely at 30-60° relative to the direction in which the column of pulps sinks within the digester. One stated advantage with this solution over SE 501243 (equal to WO 9516817) from Kamyr A B is that there is no risk of withdrawing released fibres that have been collected like ball bearings at the wall of the digester. A further idea in this case is that the point of suction in towards the column of pulp is to change its position such that suction is not applied at the same point, possibly also over the same fragment of chip, which may then clog the slot. What has not been appreciated is that an individual fragment of chip can block the slot only locally, and that the withdrawal slots that lie above and below in a screen having vertical withdrawal slots take over the withdrawal capacity from the point blockage. The oblique slot entails also heavy loads on the screen bars since the column of pulp will impact against the slots as they pass. The risk of hanging of the column of pulp increases if upwardly facing edges are present on the downstream side of the slot, something that is attempted solved, together with other aspects, in U.S. Pat. No. 6,344,112 through arranging the downstream edge of the slot to be recessed, in the manner that is revealed in SE 501243 from Kamyr A B, despite all bar screens there being arranged in the same vertical plane.

The Kamyr A B patent SE 525611 reveals an improved variant in which the vertical load on the screen bars has been largely reduced by placing the slots obliquely at an angle that lies instead in the region 10-25°.

A further solution that has been tested on a digester and that has been patented by Metso Paper Inc. in WO 01/31117 (equal to U.S. Pat. No. 6,889,851) reveals a screen design in which the screen bars are constituted by round rods. It is here stated that the round form facing in towards the column of chips contributes to an advantageous movement of individual fragments of chip that lie in line with the withdrawal slot. There are, however, limited possibilities for individual fragments of chip to move within a coherent column of chips, particularly at the lower part of the digester where the chips have achieved a high degree of softening, while at the same time being exposed to a very high degree of packing, for which reason the fragments of chip lock to each other.

Variants are shown in U.S. Pat. No. 3,752,319 from Kamyr A B and in U.S. Pat. No. 6,312,590 from Metso Paper Inc. in which every second screen bar is mobile, with the purpose of counteracting clogging. The solution will be complicated and expensive, and it risks becoming clogged in the hostile alkaline environment with a high fraction of black liquor. Every second rod in this case is suspended in a joint at one end such that it can be pivoted relative to a stationary screen bar around a pivot pin at one end of the screen bar.

Kamyr A B was the first to develop continuous digesters, and has now been acquired by Metso Paper Inc., following an intermediate period under the name of Kvaerner Pulping. The American and Finnish sales companies of Kamyr A B, Kamyr Inc. and Ahlstrom Machinery OY, are now known by the names Andritz Inc. and Andritz OY, respectively. The principal part of the development of continuous digesters has taken place in the sphere that was previously known as Kamyr, and—during the past 10 years—within Metso Paper. The development has been intense, as has been described above, with several different proposals for improved screen designs coming principally from these actors.

A first purpose of the invention is to allow an improved screen design that has a reduced risk of clogging but that has a virtually increased width of the withdrawal slot and thus also an increased withdrawal capacity.

A second purpose is that these advantages are to be obtained without demonstrating those disadvantages that other concepts that differ in principle, in which the known self-clearing effect of the withdrawal slots is retained, entail.

A third purpose is to increase the withdrawal effect at particularly difficult withdrawal locations at which the column of pulp is subject to a high degree of packing, in particular at the bottom of the digester where the pressure is at its greatest value and the chips are in their softest condition. By using the effect from a coherent column of pulp at a high degree of packing, it is possible in these positions to create a withdrawal slot that is more than 40% larger in a functional measure than the physical withdrawal slot.

Given an optimal design within the concept according to the invention, the following effects are obtained:

- a self-clearing effect for the screen
- a large virtual suction slot in towards the column of pulp
- a narrow recessed minimum gap in the suction slot that does not allow the passage of too large fibre particles from the column of pulp if these fibre particles should, despite everything, be released from the column of pulp, and
- a high bending resistance against bulging with few components.

The purposes described above are achieved with a principle screen design according to the characterising part of claim 1, where non-independent claims make clear preferred embodiments of this principle.

The description of embodiment will be given with reference to the following drawings.

DETAILED DESCRIPTION OF THE INVENTION

Figure 1:
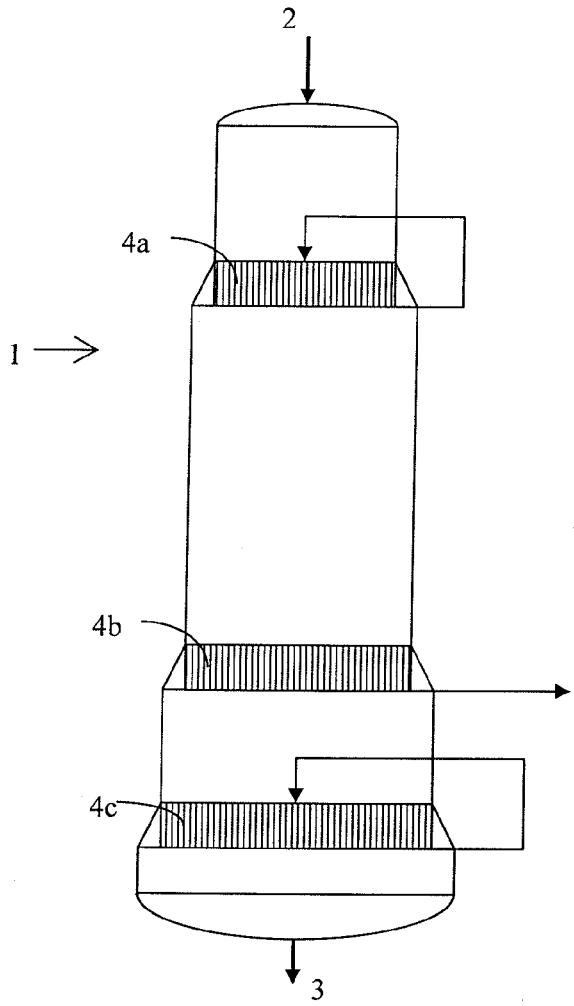
FIG. 1 shows schematically a continuous digester with screen sections

FIG. 1 shows a continuous digester 1 in which cooked cellulose pulp is produced. The continuous digester has a top at which chips 2 are added, which chips may be steam pretreated and impregnated. The cooking process takes place as the chips sink down through the digester and cooking fluid is circulated. This cooking fluid may be withdrawn at several digester screens 4*a*, 4*b*, 4*c*. The final digested pulp 3 is subsequently fed out from the bottom of the digester. The chips undergo gradual dissolving, and a large fraction, typically approximately 50% in a Kraft process, of the original wood is dissolved in the cooking fluid in the form of metals and organic material such as, for example, turpentine, tall oil and hemicellulose, and disappears with the black liquor to the evaporation process. This means that the degree of packing in the digester increases during the cooking process and it becomes evermore difficult to draw a sufficient volume of fluid in order to condition the cooking fluid during the cooking process and at the same time withdraw the organic material that has already been dissolved.

Figure 2:
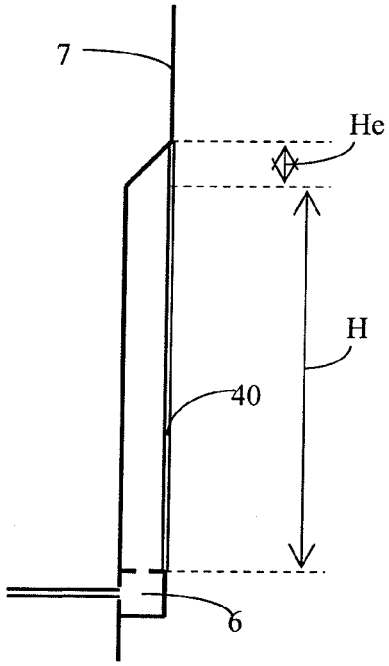
FIG. 2 shows a cross-section through a screen section of the digester

FIG. 2 shows schematically a possible appearance of the screen section in the digester. It is normal that the screen surface 40 is located in an expanded part (a "step-out") of the wall of the digester, where the upper edge of the screen lies at the same distance from the centre of the digester as the digester wall 7 that lies above it. The screen surface may have a height H, but is may also be extended such that it is in contact with the wall of the digester above the screen such that the height of the screen is extended with the length denoted "He". A chamber for withdrawn cooking fluid lies outside of the screen surface, which chamber often drains into an underlying collection chamber ("header") 6, from which the cooking fluid is withdrawn via a pipe.

Figure 3:
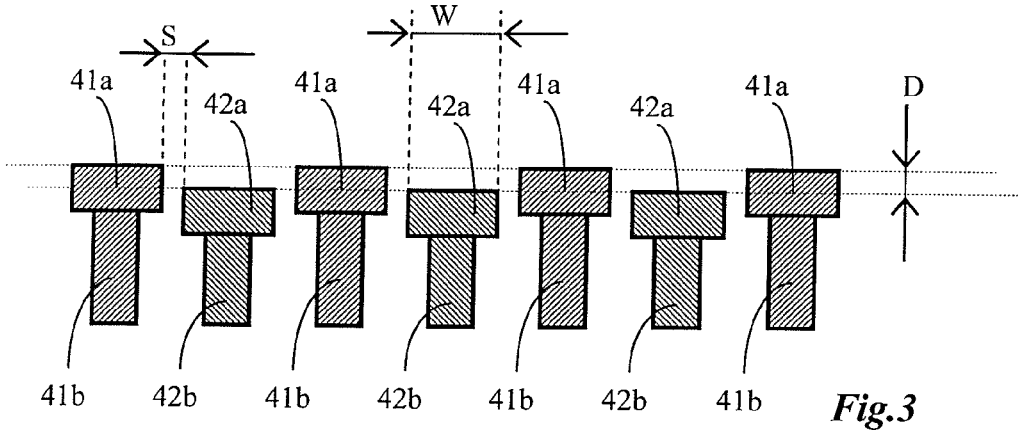
FIG. 3 shows a screen according to the invention in a first embodiment

FIG. 3 shows a first embodiment of a digester screen according to the invention comprising a number of fixed screen bars 41*a*, 42*a* arranged vertically in the continuous digester and having withdrawal slots S between the fixed screen bars. Cooking fluid is drawn from the column of pulp in the digester through the withdrawal slots S. According to the invention, one screen bar 42*a* is fixedly arranged and recessed by a distance D relative to the neighbouring screen bars 41*a*. The distance D has been established between surfaces from the inner surface of the screen bars and said inner surface directed towards the column of chips. The drawing shows that a number of screen bars in the digester screen are recessed, and that these bars in this embodiment correspond to every second bar. Alternatively, fewer screen bars in the screen surface may be recessed, such as, for example, every third bar, every fourth bar, etc.

The recessed screen bars 42*a* are for optimal effect recessed by a distance D that is at least as large as the width of the withdrawal slot S between neighbouring screen bars, and the recessed screen bars are preferably recessed by a distance D along their complete vertical length.

Figure 4:
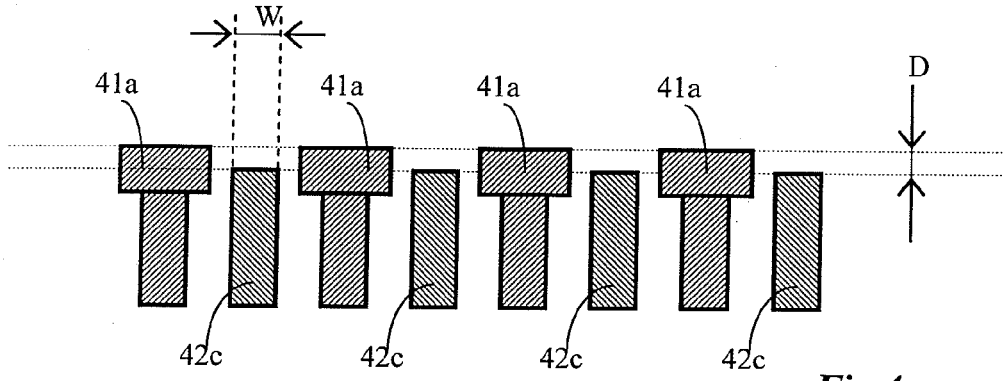
FIG. 4 shows a screen according to the invention in a second embodiment

The recessed screen bars 42*a* in this first embodiment shown in FIG. 3 have a width W that is equal to the width of the non-recessed screen bars 41*a*, but it is advantageous if the width of the recessed screen bars 42*a* does not exceed the width of the neighbouring screen bars 41*a*, which width W runs in the direction of the periphery of the digester. A variant of the invention is shown in FIG. 4 in which the width W of the recessed screen bars 42*c* is less than the width of the neighbouring screen bars 41*a*.

In order that the digester screen have a high durability and to avoid the risk of lateral buckling of the bar screens, it is advantageous that all screen bars have a greater flexural rigidity directed radially in the digester than their flexural rigidity in the direction of the digester circumference. This can be established if the dimension of the screen bars in the radial direction is at least 100% greater than the dimension of the screen bars in the direction of the digester circumference.

According to one well-tested design of the screen bars, at least the non-recessed screen bars have a T-formed cross-section, with a first broad glide surface facing in towards the column of chips of the digester at a glide part 41*a*, and a narrower radially directed web section 41*b*. This T-formed cross-section is possessed by the non-recessed screen bars in both FIG. 3 and FIG. 4, since these screen bars absorb the greater part of the radially directed forces from the column of pulp P. These bar screens are manufactured preferably through extrusion such that the glide part 41*a* and the web 41*b* are manufactured as one single profiled rod.

The withdrawal slot (S) typically has a dimension in the interval 2-10 mm, where the slot is adapted to the quality of chips that are used in the cooking process. Chips that are better defined and well-chopped with a low content of finely divided material are cooked in digesters having larger withdrawal slots, while chips with a higher content of finely divided material require a smaller withdrawal slot.

According to the invention, the recessed screen bars are preferably recessed by a distance D relative to neighbouring screen bars 41*a*, which dimension D lies in the interval 2-10 mm, and even more preferably are the recessed screen bar recessed by a distance D relative to neighbouring screen bars 41*a*, which dimension D is given in terms of the dimension of the withdrawal slot S by:

$$D=1.0*S \text{ to } 2.0*S.$$

Figure 5:
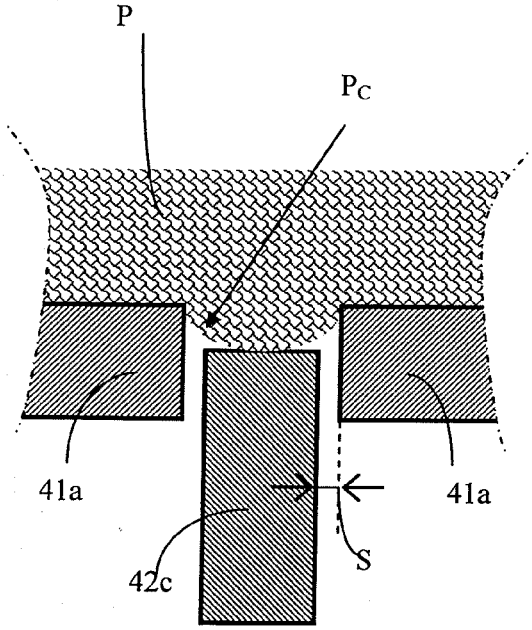
FIG. 5 shows how the column of pulp in the digester expands over a recessed screen bar

FIG. 5 shows how this design permits the column of pulp P to expand over the recessed screen bar 42*c*. The column of pulp, which to all extents and purposes behaves as a coherent column of chips, sinks by an even motion of the column of chips if the digester is operated in the manner intended. The chips are already packed at the top of the digester as playing cards that are thrown out over the floor, i.e. with their flat surfaces lying against each other.

The packing achieves a slightly cone-formed shape in gas phase digesters in which the chips establish a pointed pile above the liquid level, this cone sloping downwards from the centre of the digester out towards the walls of the digester. The chips lock each other, and as the cooking process progresses the chips are softened and collapse inwards as 50% of the organic material is dissolved in the cooking fluid. The degree of packing and the mutually locking forces between the fragments of chip increase as the duration of the cooking process increases. FIG. 5 illustrates how the fragments of chip lock against each other in the column of pulp and how, in the region of the recessed screen bar, the column of pulp can undergo an expansion such that it bulges out in the manner shown towards the surface of contact of the recessed screen bar. The bulge gives rise to a gentle curvature $P_C$ in the bulge.

It is here made clear that the suction gap facing the column of chips P is enlarged in practice from S such that it becomes of the order of magnitude of $S*\sqrt{2}$, i.e. an increase of the suction gap in practice of just over 40%.

The degree of bulging will be less in positions in the digester where the column of chips is well-packed, which preferably is the case at lower positions in the digester. If the column of chips is well-packed and a bulge does not arise at the passage over the screen surface, a suction gap from the bed is obtained with magnitude 2*S+W. This results in an increase in the suction gap of 100-250%, depending on the size of S.

Figure 6:
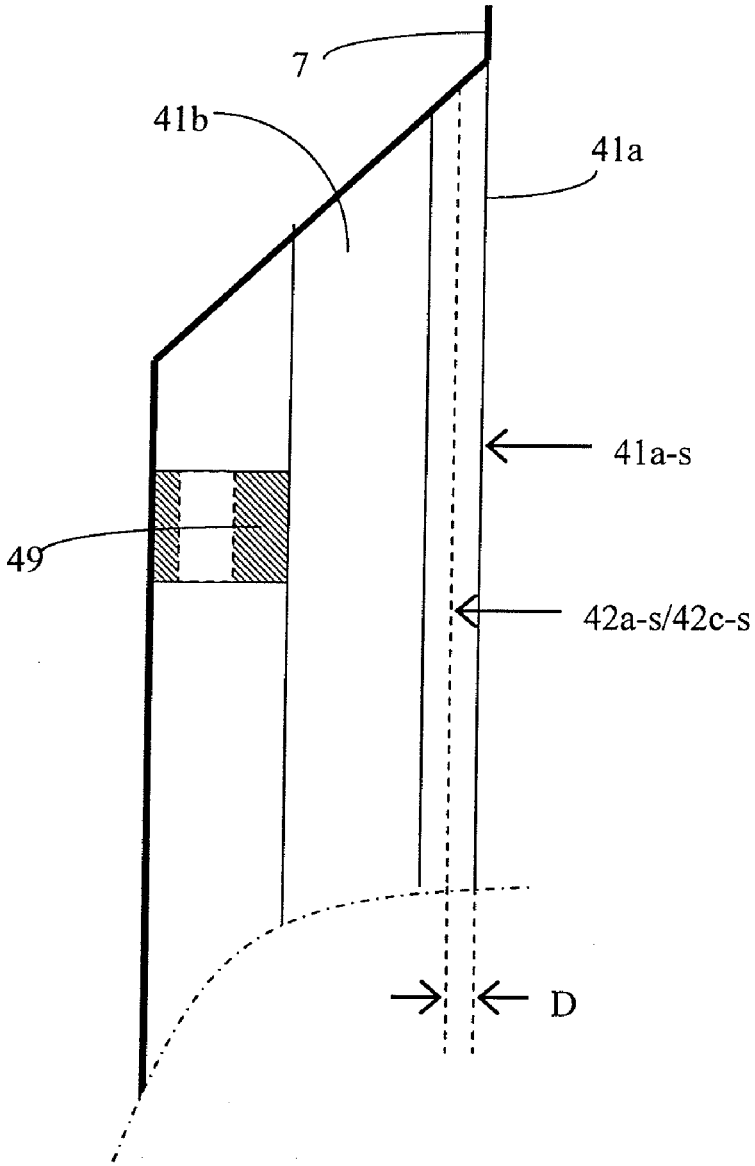
FIG. 6 shows from the side the screen arrangement in a screen section in the digester.

FIG. 6 shows schematically how the digester screen is installed in the wall of the digester. A non-recessed bar screen 41*a* can here be seen with its inner glide surface and the supporting web section 41*b*, where the glide surface is labelled 41*a-s*. The glide surface of the recessed bar screen is drawn in a dot-dash line (to denote that it is hidden from view) and labelled 42*a-s*/42*c-s*. The drawing makes it clear that the surfaces 41*a-s* of the non-recessed screen bars that face the column of pulp of the digester are located at the same distance from the centre of the column of pulp as the wall of the digester 7 directly above the screen section (4*a*, 4*b*, 4*c* in FIG. 1) with the relevant screen bars (41*a*). Every second screen bar, i.e. the recessed screen bars 42*a*/42*c*, has its glide surface recessed by the distance D relative to the glide surfaces 41*a-s* of the non-recessed screen bars.

A horizontally placed support beam 49 is preferably arranged behind the screen bars against the inner wall of the digester shell. The support beam has preferably open parts as shown, in order to make possible drainage of the withdrawn cooking fluid into the collection chamber (see reference number 6 in FIG. 2).

The digester screen according to the invention is preferably arranged at the lower part of the digester, below the half-height of the digester where the column of pulp is subject to a high degree of packing or, at the earliest, at the screen section where cooking fluid that has been consumed in the digester, known as black liquor, is withdrawn.

The invention can be designed in a number of ways within the framework of the patent claims. The recessed screen bars, for example, can have a circular cross-section (as is the case in U.S. Pat. No. 6,889,851), or they may have a pointed form (corresponding to that shown in U.S. Pat. No. 5,234,550, FIG. 1). The basic principle is that the non-recessed screen bars absorb the greater part of the radially directed forces on the screen section, while the recessed screen bars are more for the purpose of supporting the bulge that arises above the recessed screen bar. It is through the controlled bulge form that the virtually increased suction gap is created in the screen design.

While the present invention has been described in accordance with preferred compositions and embodiments, it is to be understood that certain substitutions and alterations may be made thereto without departing from the spirit and scope of the following claims.

The invention claimed is:

1. A digester screen for a continuous digester in which cooked cellulose pulp is produced, comprising:

a vertical screen surface having a number of fixed screen bars fixed in a wall of the continuous digester and arranged vertically in the continuous digester, vertical withdrawal slots (S) defined between the fixed screen bars, through which withdrawal slots cooking fluid is withdrawable from the column of pulp (P) of the digester, and at least one screen bar in the digester screen being fixedly arranged in the wall of the digester and recessed by a distance (D) relative to adjacent fixed screen bars.

2. The digester screen according to claim 1, wherein several fixed screen bars in the digester screen are recessed relative to adjacent fixed screen bars.

3. The digester screen according to claim 2, wherein the recessed screen bars are recessed by the distance (D), which is at least as large as a width of the withdrawal slot between adjacent fixed screen bars.

4. The digester screen according to claim 3, wherein the recessed and fixed screen bars are recessed by the distance (D) along a complete vertical distance of the screen bars.

5. The digester screen according to claim 4, wherein the recessed and fixed screen bars have a width (W) that does not exceed a width of the adjacent screen bars, the width (W) extends in a direction of a circumference of the digester.

6. The digester screen according to claim 5, wherein all fixed screen bars have a greater flexural rigidity in a radial direction in the digester than a flexural rigidity in a circumferential direction of the digester, a dimension of the screen bars in the radial direction is at least 100% greater than a dimension of the screen bars in the circumferential direction of the digester.

7. The digester screen according to claim 1 wherein a non-recessed fixed screen bars has a T-shaped cross-section that has a first broad glide surface facing towards the column of pulp of the digester at a glide surface and a narrower radially directed web section.

8. The digester screen according to claim 1 wherein the withdrawal slot (S) has a dimension in an interval of 2-10 mm.

9. The digester screen according to claim 1 wherein recessed fixed screen bars are recessed by the distance (D) relative to adjacent fixed screen bars.

10. The digester screen according to claim 1 wherein recessed fixed screen bars are recessed by the distance (D) relative to adjacent fixed screen bars the dimension (D) is related to a dimension (S) of the withdrawal slot by D =1.0*S to 2.0*S.

11. The digester screen according to claim 7 wherein surfaces of the non-recessed and fixed screen bars that face the column of pulp (P) of the digester are located at a same distance from a center of the column of chips as the wall of the digester directly above a screen section (4*a*, 4*b*, 4*c*) with relevant screen bars.

12. The digester screen according to claim 1 wherein the digester screen is arranged at a lower part of the digester, below a half-height of the digester.

13. The digester screen according to claim 1 wherein the fixed screen bars are flush with the vertical screen surface and the at least one screen bar is recessed by the distance (D) relative to the adjacent fixed screen bars that are flush with the vertical screen surface.

14. The digester according to claim 13 wherein the fixed screen bars each has a glide part that is perpendicular to a narrower radially directed web-section.

15. The digester according to claim 14 wherein the at least one screen bar, that is recessed, has a glide part that is parallel to the glide part of the fixed screen bars.

16. The digester according to claim 13 wherein the at least one screen bar, that is recessed, has a glide part that is perpendicular to a narrower radially directed web-section.

17. The digester according to claim 16 wherein the narrower radially directed web-section of the at least one screen bar is shorter by the distance (D) than the narrower radially directed web-sections of the fixed screen bars.

18. The digester according to claim 16 wherein the glide part of the at least one screen bar has a length (W) that is identical to a length of the glide parts of the fixed screen bars.

* * * * *